US006966167B2

(12) United States Patent
Girault

(10) Patent No.: US 6,966,167 B2
(45) Date of Patent: Nov. 22, 2005

(54) HARNESS FOR USE IN HARNESS RACING

(75) Inventor: Bernard Girault, Miniac Morvan (FR)

(73) Assignee: Pegase Saddlery Inc., Couesnon (FR)

( * ) Notice: Subject to any disclaimer, the term of this patent is extended or adjusted under 35 U.S.C. 154(b) by 0 days.

(21) Appl. No.: 10/722,503

(22) Filed: Nov. 28, 2003

(65) Prior Publication Data

US 2004/0231303 A1 Nov. 25, 2004

Related U.S. Application Data

(60) Provisional application No. 60/429,572, filed on Nov. 29, 2002.

(51) Int. Cl.[7] ..... B68B 1/00
(52) U.S. Cl. ..... 54/50; 54/2
(58) Field of Search ..... 54/2, 50, 51, 52, 54/37.1; 119/816, 817

(56) References Cited

U.S. PATENT DOCUMENTS 430,303 A * 6/1890 Simpson ..... 54/2
489,087 A * 1/1893 Nolen ..... 54/50
683,742 A * 10/1901 Finch ..... 54/37.1
818,260 A * 4/1906 King ..... 54/50
4,414,790 A * 11/1983 Mitchell ..... 54/2
5,076,041 A * 12/1991 Proust ..... 54/2
5,410,863 A * 5/1995 Mouzon ..... 54/2
6,354,247 B1 * 3/2002 Andrews ..... 119/816
6,698,168 B1 * 3/2004 Terwilliger ..... 54/2

* cited by examiner

*Primary Examiner*—Michael J. Carone
*Assistant Examiner*—Elizabeth Shaw
(74) *Attorney, Agent, or Firm*—Robert F. Delbridge

(57) ABSTRACT

A harness for horse racing has a back-engaging tree with an arched body shaped to fit across a horse's back, a pair of laterally-spaced fork members projecting downwardly from opposite sides of the arched body so as to extend downwardly on opposite sides of the horse's body when in use, and a pair of laterally-spaced independently resiliently deflectable spring members extending rearwardly from the arched body and shaped to confirm with the shape of a horse's back. A girth strap assembly is attached to the back-engaging tree, the girth strap assembly having shaft attachments on opposite sides thereof below the back-engaging tree for attaching the shafts of a sulky thereto.

7 Claims, 4 Drawing Sheets

HARNESS FOR USE IN HARNESS RACING

RELATED APPLICATION

This application claims priority from U.S. Provisional Patent Application No. 60/429,572 filed Nov. 29, 2002.

FIELD OF INVENTION

This invention relates to harnesses for use in harness racing in which standard bred horses pull two-wheeled sulkies on which a driver is seated.

BACKGROUND OF INVENTION

Harnesses worn by horses in harness racing have of course to be designed for pulling a sulky and such harness design has remained substantially unchanged for many years. A problem with known harnesses of this kind is that they cause significant discomfort to the horse with the result that the horse's trotting or pacing performance may be adversely affected.

It is therefore an object of the invention to provide a harness for harness racing which is not only effective in pulling a sulky but which causes less discomfort to the horse than known harness of this kind.

SUMMARY OF INVENTION

It has been found that such harnesses can be improved if a back-engaging member resembling a saddle tree as described and claimed in U.S. Pat. No. 6,223,509 (Girault) issued May 1, 2001 is attached to the girth strap assembly of the harness, the shafts of the sulky being secured to the girth strap assembly in a manner which will be readily apparent to a person skilled in the art. The contents of the above mentioned patent are hereby incorporated herein by reference.

The back-engaging member provides substantially more comfort for the horse than known arrangements with the result that the performance of the horse is improved.

DESCRIPTION OF DRAWINGS

One embodiment of the invention will now be described, by way of example, with reference to the accompanying drawings, of which.

DESCRIPTION OF PREFERRED EMBODIMENT

Figure 1:
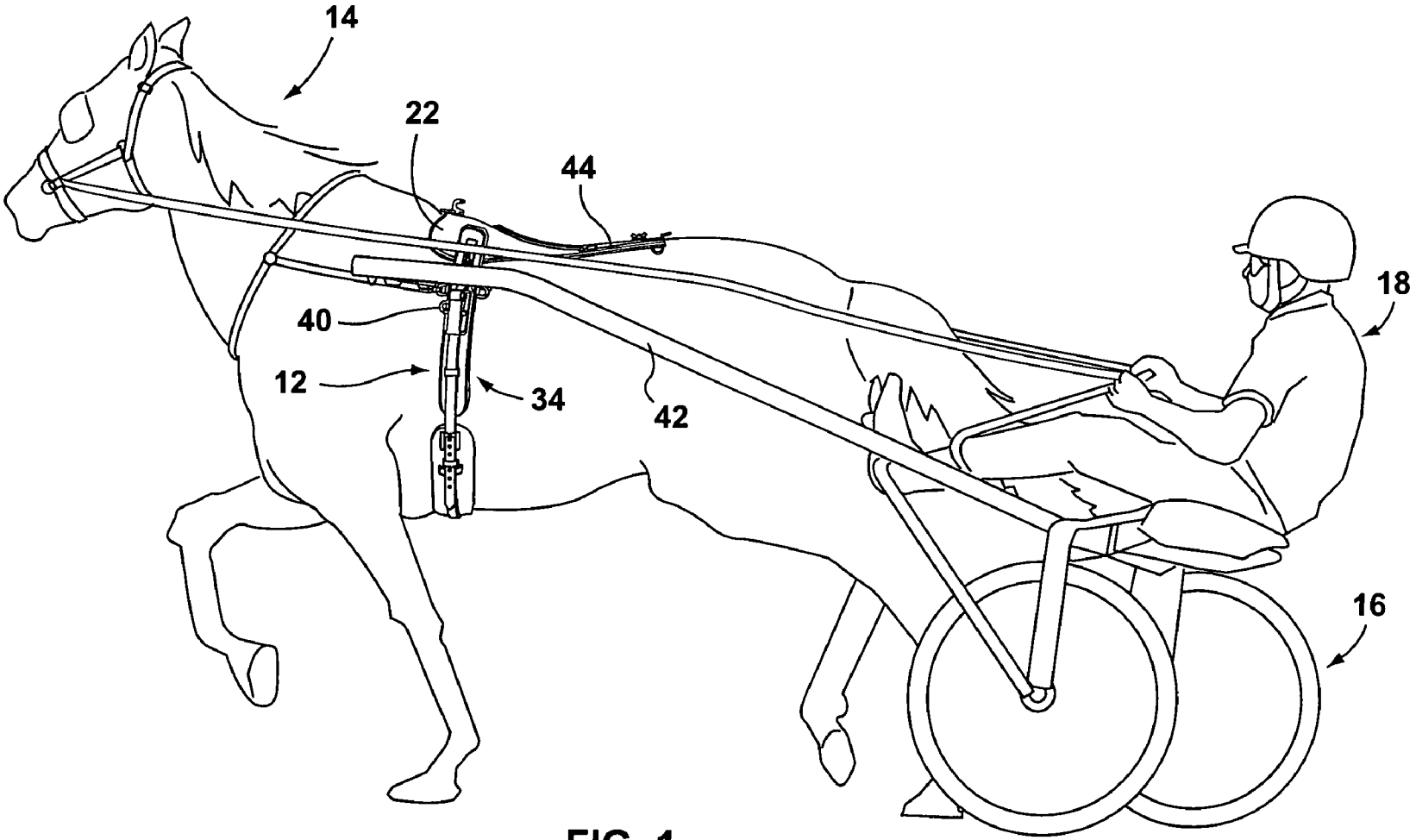
FIG. 1 is a side view of a horse fitted with a harness in accordance with one embodiment of the invention and with the shafts of a sulky secured thereto, the arrangement shown being suitable for trotting.
Figure 2:
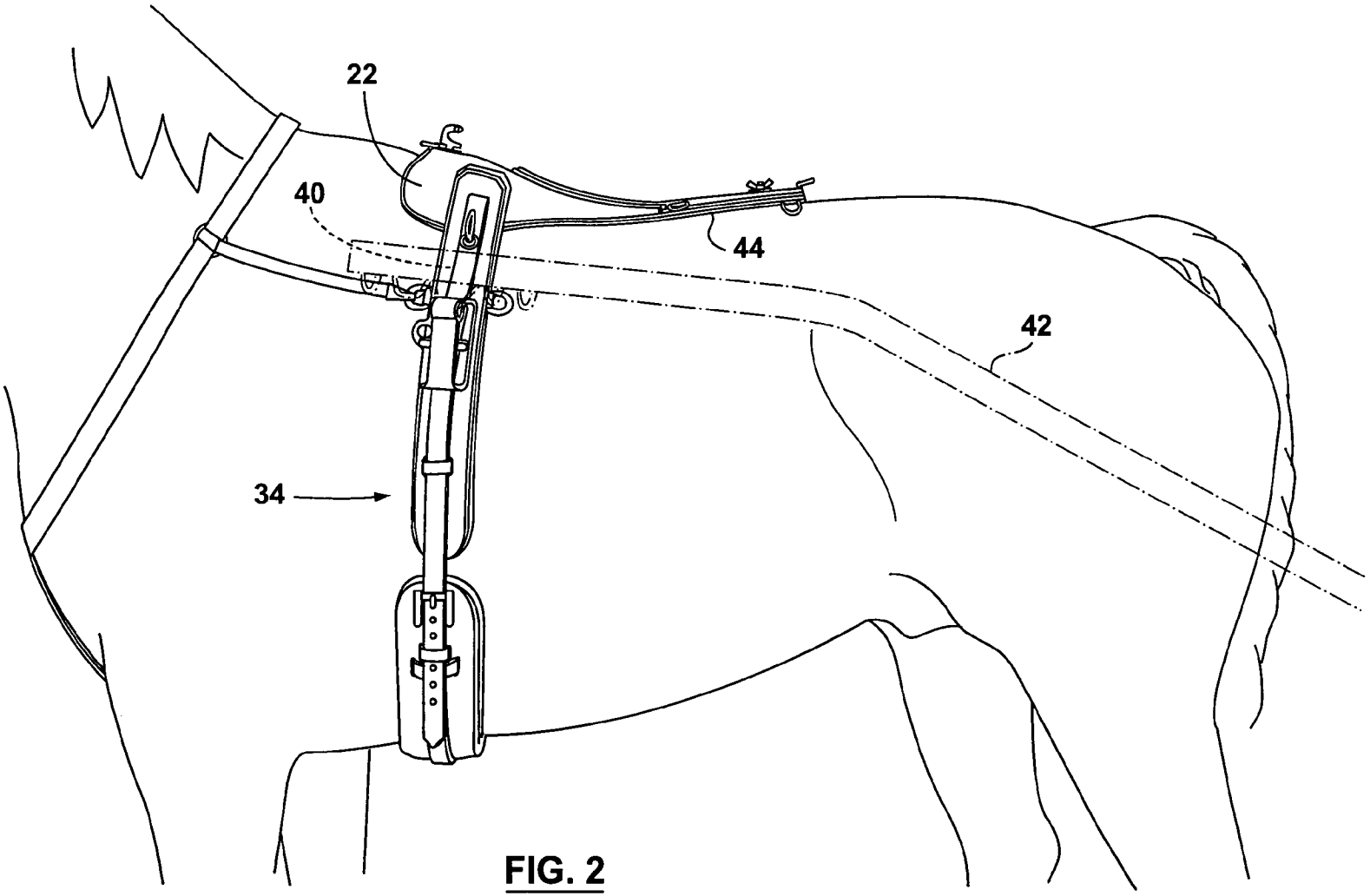
FIG. 2 is a similar view but on an enlarged scale of the body of the horse and the harness.
Figure 3:
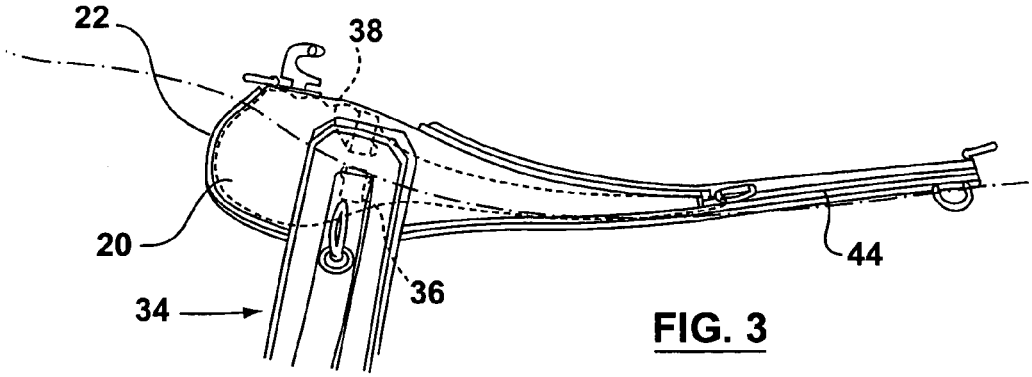
FIG. 3 is a similar view but on a still more enlarged scale of the portion of the harness which sits on the back of the horse.
Figure 4:
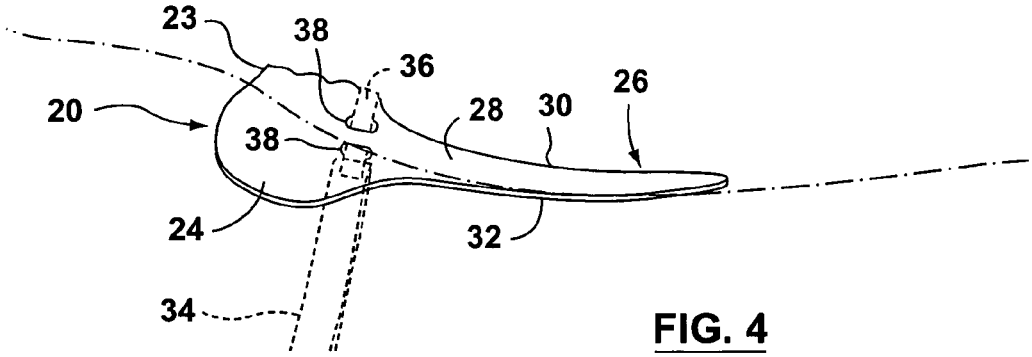
FIG. 4 is a similar but somewhat diagrammatic view of the back-engaging tree with its casing removed and showing how the back-engaging tree sits on the horse's back.
Figure 5:
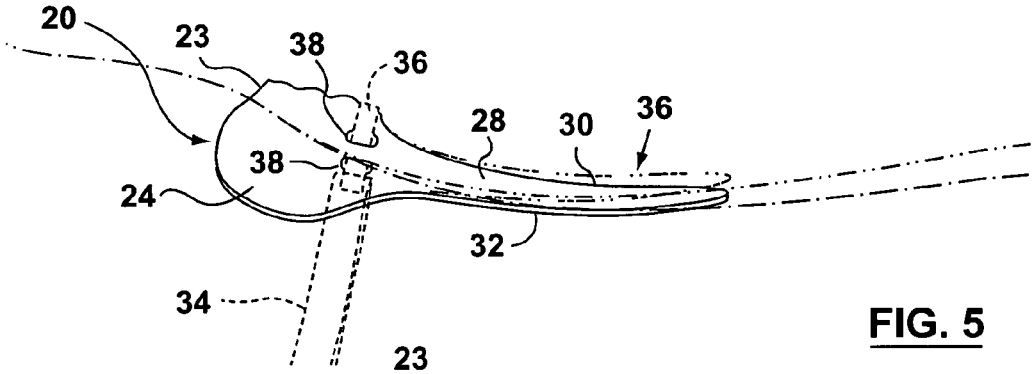
FIG. 5 is a side view showing how the spring members of the back-engaging tree resiliently deflect during the forward motion of the horse.
Figure 6:
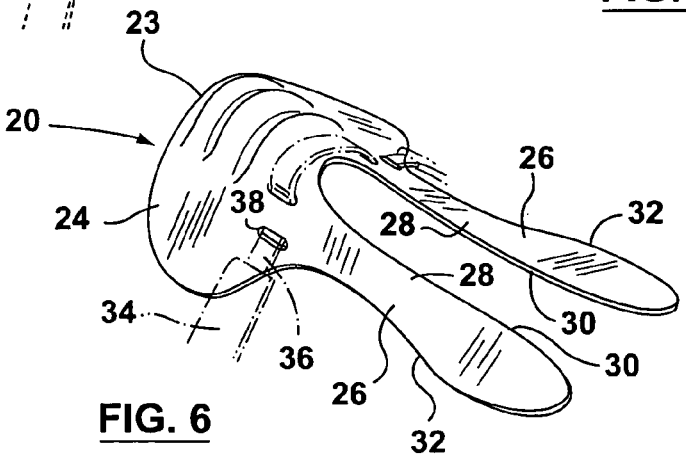
FIG. 6 is a perspective view of the back-engaging tree.

Referring first to FIGS. 1 to 6 of the drawings, a harness 12 in accordance with one embodiment of the invention and suitable for trotting is mounted on a horse 14 and connected to a sulky 16 with a driver 18. A harness 12 has a back-engaging tree 20 (see especially FIGS. 4 and 5) housed in a casing 22 of canvas-like material and located on the horse's back.

The back-engaging tree 20 is a saddle tree as described and claimed in previously mentioned U.S. Pat. No. 6,223,509. The back-engaging tree 20 is formed as an integral molding of suitable synthetic plastic material and has an arched body 23 shaped to fit across the horse's back, a pair of laterally-spaced fork members 24 projecting downwardly from opposite sides of the arched body portion 22 so as to extend downwardly on opposite sides of the horse's back, and a pair of laterally-spaced individually resiliently deflectable spring members 26 extending rearwardly from the arched body portion 22.

The spring members 26 are of blade-like shape curved to conform with the shape of the horse's back and having a length sufficient to extend along about eight vertebrae thereof and a lateral spacing such that at least laterally-inner rear edge portions 28 rest on the vertebrae. The spring members 26 have laterally inner edges 30 which, in plan view, are substantially parallel and laterally outer edges 32 which diverge in a curved manner from the arched body portion 23 to a maximum just beyond half way along the length thereof and then curve towards their rear ends.

A girth strap assembly 34 extends around the horse. The girth strap assembly 34 is generally conventional but has a somewhat modified upper portion to enable attachment to a back-engaging tree 20 in accordance with the invention to be effected. The upper portion of the girth strap assembly 34 has a relatively narrow strap 36 which is passed through apertures 38 on opposite sides of the back-engaging tree 20.

The girth strap assembly 34 has conventional shaft attachments 40 (not shown in detail) on opposite sides just below the back-engaging tree 20 to enable the shafts 42 of the sulky to be attached thereto in a conventional manner.

Figure 7:
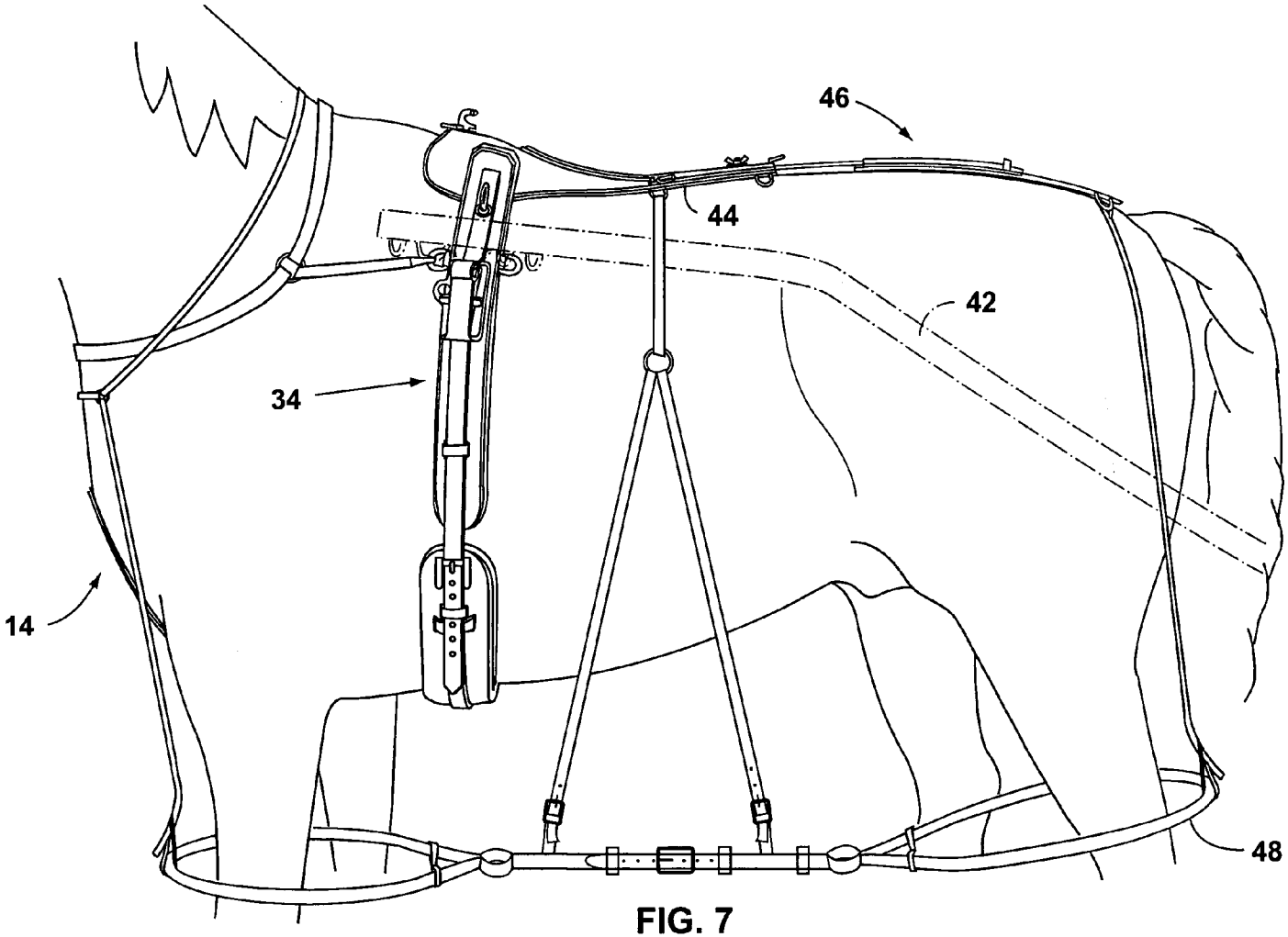
FIG. 7 is a view similar to FIG. 2 but showing additional equipment used for pacing.

The casing 22 has a rear extension 44 which extends a short distance beyond the rear end of the back-engaging tree 20. For pacing, as shown in FIG. 7, a tail extension member 46 is detachably secured thereto and the rear portion of a conventional hobble assembly 48 is connected to the rear extension member 46. With the present invention, the tail extension member 46 can terminate forwardly of the tail of the horse and does not have to have an aperture adjacent its rear end through which the tail of the horse passes as in known arrangements.

It has been found that use of a back-engaging tree in accordance with the invention provides a harness for harness racing which is a substantial improvement over known harnesses of this kind because it is more comfortable for the horse and hence likely to lead to improvement in the performance of the horse. Also, the absence of the need to anchor the rear end of the tail extension member by means of the horse's tail for trotting or pacing provides even more comfort and also more freedom of movement for the horse.

Other embodiments of the invention will now be readily apparent to a person skilled in the art from the foregoing description, the scope of the invention being defined in the appended claims.

What is claimed is:

1. A harness for horse racing having:

a back-engaging tree with an arched body shaped to fit across a horse's back, a pair of laterally-spaced fork members projecting downwardly from opposite sides of the arched body so as to extend downwardly on opposite sides of the horse's body when in use, and a pair of laterally-spaced independently resiliently deflectable spring members extending rearwardly from the arched body and shaped to conform with the shape of a horse's back, the spring members of the back-engaging tree having in plan view laterally-inner edges which are substantially parallel and laterally-outer edges which diverge in a curved manner from the arched body portion to a maximum just beyond half-way along their length and then converge towards their rear ends; and a girth strap assembly attached to the back-engaging tree, the girth strap assembly having shaft attachments on opposite sides thereof below the back-engaging tree for attaching the shafts of a sulky thereto.

2. A harness according to claim 1 wherein the spring members of the back-engaging tree have a lateral spacing causing at least laterally-inner rear-edge portions thereof to rest on the relevant vertebrae of a horse's back when in use.

3. A harness according to claim 1 wherein the spring members of the back-engaging tree have a length sufficient to extend along at least 8 vertebrae of a horse's back when in use.

4. A harness for horse racing having:

a back-engaging tree with an arched body shaped to fit across a horse's back, a pair of laterally-spaced fork members projecting downwardly from opposite sides of the arched body so as to extend downwardly on opposite sides of the horse's body when in use, and a pair of laterally-spaced independently resiliently deflectable spring members extending rearwardly from the arched body and shaped to conform with the shape of a horse's back, a girth strap assembly attached to the back-engaging tree, the girth strap assembly having shaft attachments on opposite sides thereof below the back-engaging tree for attaching the shafts of a sulky thereto, and a casing housing the back-engaging tree.

5. A harness according to claim 4 wherein the casing has a rear extension to which the rear portion of a hobble assembly is securable.

6. A harness and sulky assembly including a harness as claimed in claim 1 and a sulky having a pair of laterally-spaced forwardly-projecting shafts with front end portions attached to the shaft attachments of the harness.

7. A harness and sulky assembly including a harness as claimed in claim 5 and a sulky having a pair of laterally-spaced forwardly-projecting shafts with front end portions attached to the shaft attachments of the harness and a hobble assembly having a rear portion attached to the rear extension of the casing of the back-engaging tree.

* * * * *